US005470029A

United States Patent [19]

Dufour

[11] Patent Number: 5,470,029

[45] Date of Patent: Nov. 28, 1995

[54] QUICK REWIND CHALK LINE REEL

[75] Inventor: Jean G. Dufour, Quebec, Canada

[73] Assignee: Johnson Level & Tool Mfg. Co., Inc., Mequon, Wis.

[21] Appl. No.: 288,397

[22] Filed: Aug. 10, 1994

[51] Int. Cl.[6] ..... B65H 75/40; B44D 3/38

[52] U.S. Cl. ..... 242/394; 242/405; 33/414

[58] Field of Search ..... 242/394, 396.1, 242/405, 405.3, 260, 261, 263; 33/413, 414

[56] References Cited

U.S. PATENT DOCUMENTS

| | | | |
|---|---|---|---|
| D. 334,717 | 4/1993 | Evans, Jr. et al. | D10/65 |
| 1,087,694 | 2/1914 | Sinsinger | 242/260 |
| 3,311,319 | 3/1967 | Campbell . | |
| 3,438,595 | 4/1969 | Brown et al. | 242/394 |
| 3,721,009 | 3/1973 | Lucich | 33/414 |
| 3,834,670 | 9/1974 | Pityo | 242/394 X |
| 4,272,036 | 1/1981 | Watermann . | |
| 4,396,102 | 8/1983 | Beach | 242/394 X |

*Primary Examiner*—John M. Jillions
*Attorney, Agent, or Firm*—Andrus, Sceales, Starke & Sawall

[57] ABSTRACT

A line reel includes a housing, a spool rotatably mounted in the housing, a crank and crown gear assembly rotatably disposed in the housing and a pinion located in the housing in meshed engagement with the crank and crown assembly for rotation therewith. A release button movable into and out of meshed engagement with the spool is slidably mounted on the pinion and keyed thereto for rotation therewith. A spring is disposed between the pinion and the release button for selectively allowing locking and unlocking of the spool without movement of the crank and crown gear assembly.

10 Claims, 2 Drawing Sheets

QUICK REWIND CHALK LINE REEL

BACKGROUND OF THE INVENTION

The invention relates generally to a line reel having a crank rewinding line on the reel which can be locked or unlocked as desired and, more particularly, relates to a chalk line reel containing a spool of line which passes through a chamber filled with powdered chalk.

DESCRIPTION OF THE PRIOR ART

Chalk lines are widely used during building construction for marking lines on floors, walls and the like where cuts are to be made or cabinets, shelves and other built-in furnishings are to be installed. A chalk line is wound on a reel or spool and coated with dry chalk. The free end of the chalk line is held at a predetermined location and the chalk line is stretched to the opposite end of a line to be marked. The ends of the chalk line are placed against the surface to be marked and the length of the chalk line therebetween is stretched taut. The center of the chalk line is then drawn outwardly from that surface and released. The resiliency of the chalk line causes the line to rebound against the surface to be marked, thereby causing a linear chalk marking to be formed upon a wall or floor. Markings of this type facilitate the making of straight cuts and the installation of lengthy furnishings.

During use, it may be desirable to manually pull the chalk line from the spool until the required length of line has been extended from the housing. At other times, it may be desirable to prevent the line from being pulled from the housing, as, for example, when the line is being used to mark guidelines. In conventional direct drive and gear drive reels, manual extension of the line causes the crank to turn, while the line can only be locked by manually holding the crank fixed relative to the housing.

One example of solving this problem is disclosed in U.S. Pat. No. 4,272,036 issued Jun. 9, 1981 to Watermann. In this device, a line reel includes a spool for line, a drive shaft effecting rotation of the spool through suitable gears and a manually operable crank hinged to the drive shaft. The drive shaft has a clutch part releasably engageable with a cooperating clutch part on one of the gears. A cam surface on the crank causes the crank, when pivoted to a selected locked or cranking position, to be moved to an over-center position at which a spring holds the crank in a selected position. In locked position, the clutch parts are disengaged and the spool stops are engaged. In cranking position, the clutch parts are engaged and the stops are disengaged. The crank may be moved to disengage both the stops and the clutch parts so that the wound line may be manually extended from the spool without affecting rotation of the crank. While this line reel generally performs its intended function, its multiplicity of parts must be accommodated in an expanded housing and the crank must be manipulated to unlock the spool for paying out line.

Another example of a chalk line reel or marker which attempts to lock the spool in fixed position until being released is disclosed in U.S. Pat. No. Des. 334,717 issued Apr. 13, 1993 to Evans, Jr. et al. Mechanically, this arrangement includes a release button incorporated on the pivoting end of the crank on the top of the housing. With this design, however, it has been observed that a snapping or forceful pulling of the line will trip the locking device and cause the undesired rotation of the crank.

Accordingly, it remains desirable to provide an improved line reel of a modified type from that shown in the aforementioned prior art which is effective to insure positive locking of the spool in a fixed position until released. It is also highly desirable that such assembly have a compact design for accommodating a unique gear arrangement between the crank and the spool. Such gear arrangement should allow for consistent, quick rewinding of the spool when desired.

SUMMARY OF THE INVENTION

The line reel of the present invention advantageously provides a positive, reliable locking arrangement to positively maintain the spool in a locked position until affirmatively released by the operator. The line reel contemplates a unique gearing construction designed to provide consistent, and speedy retraction of line which has been paid out upon the spool.

These and other aspects of the invention are realized in a line reel comprising a housing having a top, a bottom and an aperture formed therein and a spool rotatably mounted in the housing and carrying a line extensible and retractable through the aperture. A crank and crown gear assembly is rotatably disposed in the housing and a pinion disposed in the housing is in meshed engagement with the crank and crown gear assembly for rotation therewith. A release button is slidably mounted on the pinion and keyed thereto for rotation therewith, the release button being movable into and out of meshed engagement with the spool. A biasing means is disposed between the pinion and the release button for selectively allowing locking and unlocking of the spool for rotation without movement of the crank and crown gear assembly.

In another aspect of the invention, a line reel having a spool for winding line thereabout, a shell housing in which the spool is rotatably mounted and having an aperture through which the line extends, a crank operably engaged with the spool and means for positively locking the spool in the fixed position until released includes an improvement wherein the means for positively locking the spool in the fixed position includes a release button disposed in the shell housing independent of the crank and movable into and out of meshed engagement with the spool to alternatively prevent and allow line to be unwound from the spool without movement of the crank. The line reel includes gear means for interconnecting the crank and the spool, the gear means comprising a crown gear integral with the crank and a pinion in continuous meshing engagement with the crown gear and in keyed relationship with the release button.

BRIEF DESCRIPTION OF THE DRAWINGS

The invention will become better understood by reference to the following detailed description of the preferred exemplary embodiment when read in conjunction with the appended drawing, wherein like numerals denote like elements

DETAILED DESCRIPTION OF THE PREFERRED EMBODIMENTS

Figure 1:
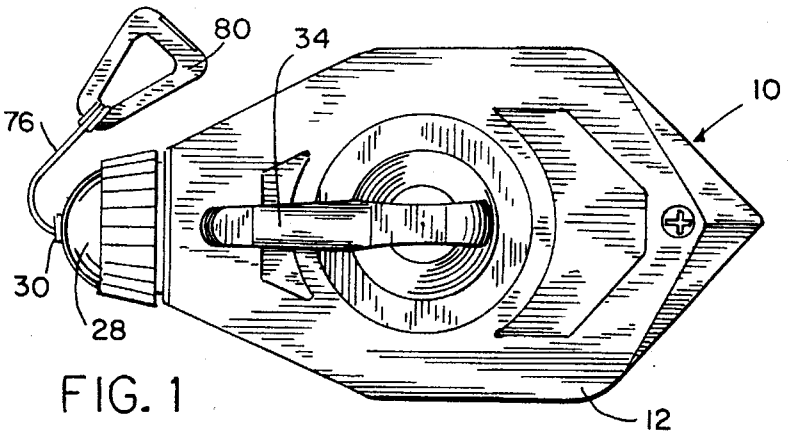
FIG. 1 is an elevational view of the line reel embodying the present invention.

Referring now to FIGS. 1–4, a chalk line reel 10 includes a housing 12 defined by a bottom shell 14 and a top shell 16. A pair of screws 18 are inserted through bottom shell 14 and threaded into respective bosses 20 defined by top shell 16 to secure the housing portions together. Ends 22, 24 on bottom shell 14 and top shell 16 are formed with threading 26 which defines an open collar on which a cap 28 with an eyelet 30 is suitably threaded for a purpose to be appreciated hereafter.

Mounted for rotation in bottom shell 14 is a crank and crown gear (hub) assembly 32 comprising a crank 34 swingably mounted through 180° about a pivot 36 on crown gear 38. The distal end of crank 34 includes a swivel knob 40 normally held recessed in a valley 42 formed in bottom shell 14. Crown gear 38 is rotatably disposed on an upstanding boss 44 of a fixed back plate 46 underlying crown gear 38 and is provided with inwardly extending gear teeth 48 in constant meshed engagement with outwardly extending gear teeth 50 on the top portion of a vertically oriented pinion 52. Pinion 52 extends through an opening formed in back plate 46. An outwardly extending flange portion 54 of pinion 52 abuts a shoulder defined by an inwardly extending flange portion 56 on back plate 46 to establish the position of pinion 52 relative to back plate 46 and crown gear 38 and to rotatably mount pinion 52 to back plate 46. Pinion 52 is formed with a central cavity 58 for accommodating a compression spring 60 which extends downwardly and is seated in a depression 62 provided in the interior of a generally cylindrical shaped member 64 forming a release button positioned to be accessible from top shell 16. The bottom portion of pinion 52 is keyed into the interior of release button 64 such that release button 64 is slidably mounted upwardly or downwardly along pinion 52 depending on the force applied to spring 60 and is rotatably mounted therewith. Release button 64 includes outwardly extending gear teeth 66 meshable with complementary gear teeth 68 extending inwardly from a central hub 70 of a spool 72 disposed for rotation in housing 12 between back plate 46 and top shell 16. Suitable seals 74 are positioned beneath back plate 46 and beneath spool 72. Connected to central hub 70 is a line or cord 76 which is wound about spool 72 and exits through open collar 26 and eyelet 30, terminating in a hook 80. Shells 14, 16 and back plate 46 when assembled define an internal cavity 78 adapted to be filled with powdered chalk to coat line 76 in a conventional manner. Lodged within cap 28 is a wiping member 82 in the form of a piece of felt or cloth which serves to remove excess chalk from line 76 before it is pulled out.

When desired, cap 28 is removed from threads 26 to enable the user to fill cavity 78 with powdered chalk, and is thereafter replaced.

Figure 4:
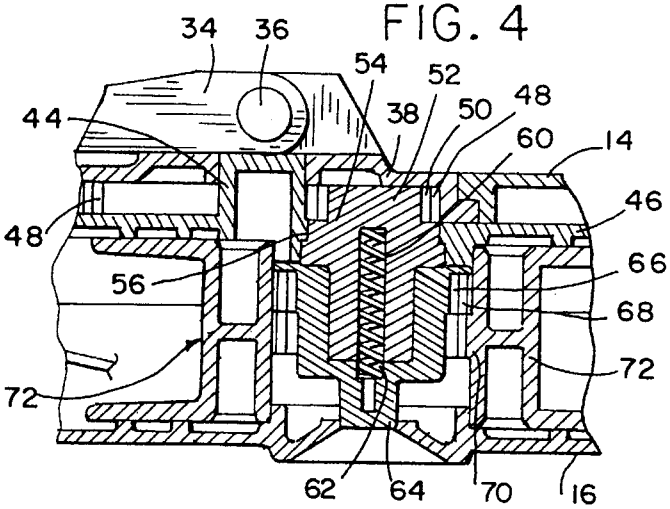
FIG. 4 is a fragmentary, cross-sectional view similar to FIG. 3 but showing the line reel in a released position.
Figure 3:
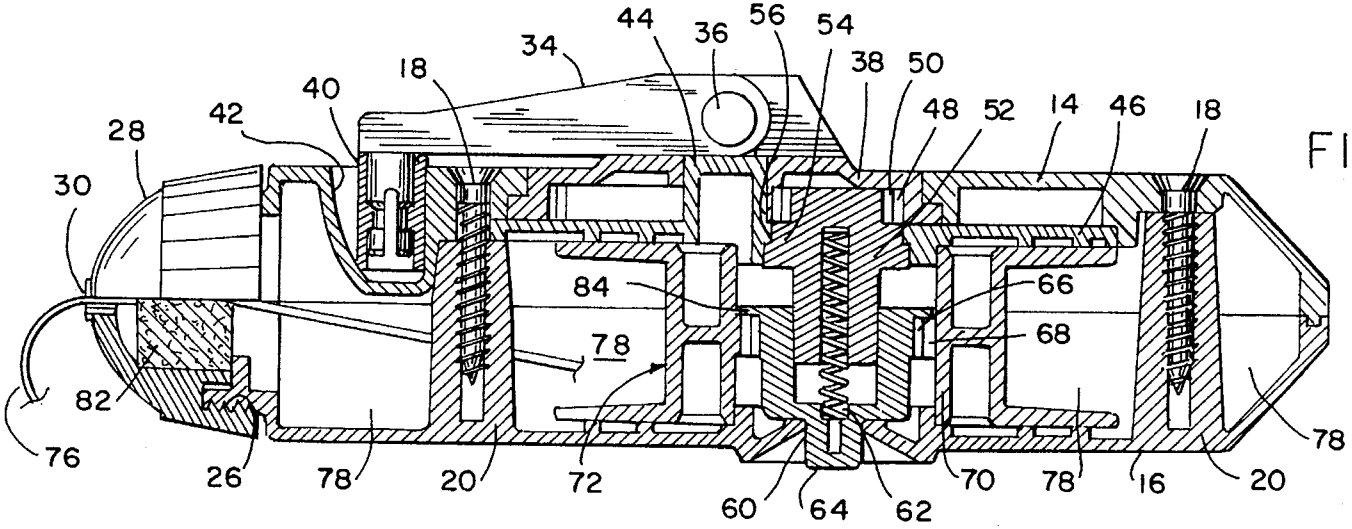
FIG. 3 is a cross-sectional view of the line reel showing the spool in locked position.
Figure 2:
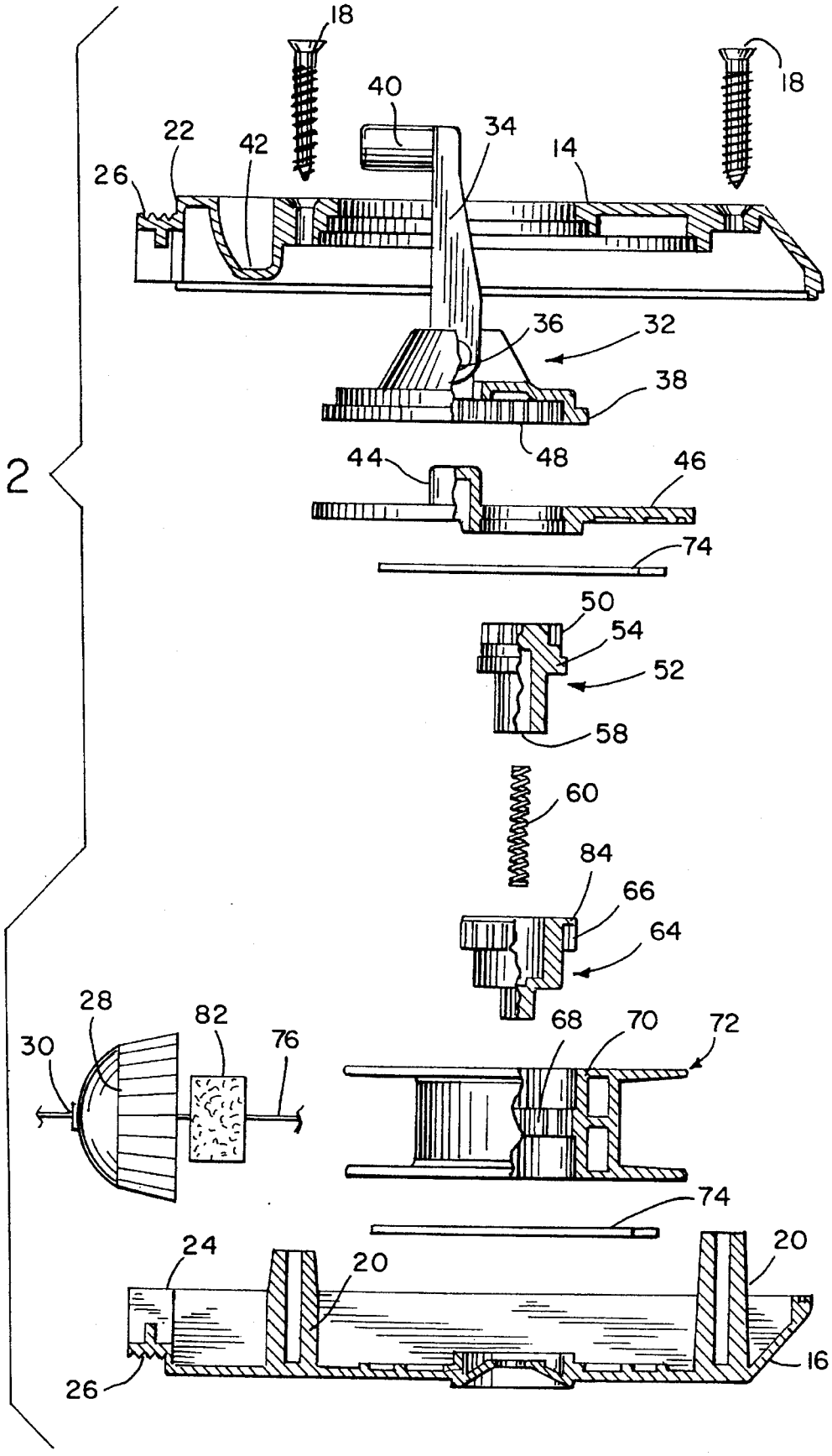
FIG. 2 is an exploded view of the components of the line reel assembly shown in FIG. 1.

Referring now to FIG. 3 it can be seen that with crank 34 in a locked or recessed position, spring 60 biases release button 64 downwardly such that gear teeth 66 of release member 64 are in meshed engagement with gear teeth 68 of spool 72. As a result, spool 72 remains positively locked and no line 76 can be manually payed out. Chalk line reel 10 is maintained in this position when stored and during use after line 76 has been payed out and stretched taut, to mark a chalk line on a surface. To pay out line 76 from spool 74 freely during use, release button 64 is manually pressed against the force of spring 60, as shown in FIG. 4, release button 64 slides along pinion 52 until flange portions 84 of release button 64 contact flange portions 54 on pinion 52. At this point, gear teeth 66, 68 become disengaged to allow free rotation of spool 72 and payout of line 76 without the undesirable turning of crank 34. When it is desired to reel in line 76, button 64 is released to reengage gear teeth 66, 68. Crank 34 is swung 180° about pivot 36 after which it is rotated to impart rotation to crown gear 38, pinion 52, release button 64 keyed thereto, and spool 72. The use of a relatively large diameter drive gear, in this case crown gear 38, to rotate a relatively small diameter driven gear, in this case gear teeth 50 of pinion 52, provides a "rapid rewind" feature to chalk line reel 10 by rotating spool 72 at a rate faster than that at which crank 34 is rotated.

It should be appreciated that the constant engagement among crown gear 38, pinion 52 and release member 64 allows for quick rewinding of spool 72 in a compact housing package. It should likewise be appreciated that the present invention provides a positive spool locking mechanism which is independent of crank 34 unlike prior art chalk line reels.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

I claim:

1. A line reel comprising;

a housing having a top, a bottom and an aperture formed therein;

a spool rotatably mounted in said housing and carrying a line extensible and retractable through said apertures;

a crank and crown gear assembly rotatably disposed on said housing;

a pinion disposed in said housing in meshed engagement with said crank and crown gear assembly for rotation therewith;

a release button slidably mounted on said pinion and keyed thereto for rotation therewith, said release button being movable into and out of meshed engagement with said spool; and biasing means disposed between said pinion and said release button for selectively allowing locking and unlocking of said spool for rotation without movement of said crank and crown gear assembly.

2. The line reel of claim 1, wherein said release button is located independent of said crank and crown gear assembly.

3. The line reel of claim 1, wherein said release button is accessible through the top of said housing.

4. The line reel of claim 1, wherein said crank and crown gear assembly is located on the bottom of said housing.

5. The line reel of claim 1, wherein said crank and crown gear assembly is movable between locked and cranking positions.

6. The line reel of claim 1, wherein said spool has a central hub defining a hollow interior therethrough.

7. The line reel of claim 6, wherein said pinion and said release button are disposed in said central hub.

8. The line reel of claim 6 wherein said central hub is provided with internal gear teeth selectively engageble with a portion of said release button to control locking of said spool.

9. The line reel of claim 8, wherein said release button is provided with external gear teeth movable into and out of meshed engagement with said internal gear teeth on said central hub.

10. The line reel of claim 1, wherein said crank and crown gear assembly are in constant meshed engagement with said pinion.

* * * * *